United States Patent [19]

Thanagavelu

[11] Patent Number: 5,022,497

[45] Date of Patent: Jun. 11, 1991

[54] "ARTIFICIAL INTELLIGENCE" BASED CROWD SENSING SYSTEM FOR ELEVATOR CAR ASSIGNMENT

[75] Inventor: Kandasamy Thanagavelu, Avon, Conn.

[73] Assignee: Otis Elevator Company, Farmington, Conn.

[21] Appl. No.: 318,295

[22] Filed: Mar. 3, 1989

Related U.S. Application Data

[63] Continuation-in-part of Ser. No. 209,744, Jun. 21, 1988, Pat. No. 4,838,384.

[51] Int. Cl.[5] ..... B66B 1/18

[52] U.S. Cl. ..... 187/124; 187/127

[58] Field of Search ..... 187/124, 125, 127

[56] References Cited

U.S. PATENT DOCUMENTS

| | | | |
|---|---|---|---|
| 3,857,465 | 12/1974 | Iwasaka et al. | 187/128 |
| 4,023,135 | 5/1977 | Hanmura et al. | 340/1 R |
| 4,030,572 | 6/1977 | Kaneko et al. | 187/125 |
| 4,112,419 | 9/1978 | Kimoshita et al. | 340/1 R |
| 4,244,450 | 1/1981 | Umeda aet al. | 187/124 |
| 4,303,851 | 12/1981 | Mottier | 235/92 PK |
| 4,305,479 | 12/1981 | Bittar et al. | 187/125 |
| 4,323,142 | 4/1982 | Bittar | 187/127 |
| 4,330,836 | 5/1982 | Donofrio et al. | 364/567 |
| 4,363,381 | 12/1982 | Bittar | 187/127 |
| 4,411,338 | 10/1983 | Kuzunuki et al. | 187/124 |
| 4,458,787 | 7/1984 | Uetani | 187/127 |
| 4,473,134 | 9/1984 | Uetani | 187/124 |
| 4,499,975 | 2/1985 | Tsuji | 187/125 |
| 4,503,941 | 3/1985 | Takabe | 187/128 |
| 4,523,665 | 6/1985 | Tsuji | 187/127 |
| 4,524,418 | 6/1985 | Araya et al. | 364/436 |
| 4,536,842 | 8/1985 | Yoneda et al. | 364/424 |
| 4,542,463 | 9/1985 | Uetani | 364/424 |
| 4,553,639 | 11/1985 | Uetani | 187/131 |
| 4,838,384 | 6/1989 | Thangauelu | 187/125 |

OTHER PUBLICATIONS

"Forecasting Methods and Applications" by Spyros Makridakis & Steven C. Wheelwright (John Wiley & Sons, Inc., 1978)—Sections 3.3, 3.6, 3.5.

*Primary Examiner*—A. D. Pellinen
*Assistant Examiner*—W. E. Duncanson, Jr.

[57] ABSTRACT

An elevator control system employing a micro-processor-based group controller (FIG. 2), which communicates with the cars (3, 4) of the system to determine the conditions of the cars, and responds to hall calls registered at a plurality of landings in the building serviced by the cars under control of the group controller, assigning hall calls to cars based on the summation for each car, relative to each call, a weighted summation of a plurality of system response factors, some indicative, and some not, of conditions of the car irrespective of the call being assigned, assigning varying "bonuses" and "penalties" to them in the weighted summation. "Artificial intelligence" techniques are used to predict traffic levels and any crowd build up at various floors to better assign one or more cars to the "crowd" predicted floors, either parking them there, if they were empty, or more appropriately assigning car(s) to the hall calls. Traffic levels at various floors are predicted by collecting passengers and car stop counts in real time and using real time and historic prediction for the traffic levels, with single exponential smoothing and/or linear exponential smoothing. Predicted passenger arrival counts are used to predict any crowd at fifteen second intervals at floors where significant traffic is predicted. Crowd prediction is then adjusted for any hall call stops made and the number of passengers picked up by the cars. The crowd dynamics are matched to car assignment, with one or more cars being sent to crowded floor(s).

11 Claims, 7 Drawing Sheets

"ARTIFICIAL INTELLIGENCE" BASED CROWD SENSING SYSTEM FOR ELEVATOR CAR ASSIGNMENT

REFERENCE TO RELATED APPLICATIONS

This application is a continuation-in-part of Ser. No. 07/209,744 entitled "Queue Based Elevator Dispatching System Using Peak Period Traffic Prediction" filed June 21, 1988, now U.S. Pat. No. 4,838,384, the disclosure of which is incorporated herein by reference.

This application also relates to some of the same subject matter as the co-pending applications listed below and owned by the assignee hereof, the disclosures of which are also incorporated herein by reference:

Ser. No. 07/192,436 of Joseph Bittar entitled "Weighted Relative System Response Elevator Car Assignment System With Variable Bonuses And Penalties" filed May 11, 1988, now U.S. Pat. No. 4,815,568 and Ser. No. 07/318,307 of the inventor hereof entitled "Relative System Response Elevator Dispatcher System Using 'Artificial Intelligence' to Vary Bonuses and Penalties" filed on even date herewith.

TECHNICAL FIELD

The present invention relates to elevator systems and to controlling cars to be dispatched in an elevator system. More particularly the invention relates to the assignment of hall calls to a selected one of a group of elevators serving floor landings of a building in common, based preferably but not necessarily on weighted Relative System Response (RSR) considerations.

These RSR considerations include factors which take into account system operating characteristics in accordance with a scheme of operation, which includes a plurality of desirable factors, the assignments being made based upon a relative balance among the factors, in essence assigning "bonuses" and "penalties" to the cars in determining which cars are to be assigned to which hall calls through a computer algorithm.

Even more particularly, the present invention relates to controlling cars to be dispatched to hall calls based on a dispatcher algorithm preferably but not necessarily with variable bonuses and penalties using "artificial intelligence" ("AI") based traffic predictors for predicting crowds at the floor and assigning cars based on predicted crowd size and car load when the car leaves the floor of the hall call.

BACKGROUND ART

General Information

When a Relative System Response (RSR) dispatcher is used for car assignment to hall calls, the car is assigned to a hall call, after the hall call is received. Thus, if a large number of people arrive at a floor at the start of down-peak or noontime or at the start or end of a special event, there is a delay in the car assignment to the floor because the hall call must first be registered. This results in large waiting time to the passengers.

Also, often the car which stops at the floor becomes full, and some people are left out. Then they have to re-register the hall call, and another car has to be sent to pick up the remaining passengers. This causes irritation to passengers and more waiting time.

When the enhanced Relative System Response algorithm of the above-referenced, concurrently filed application Ser. No. 318,307 is used, the traffic is predicted in terms of passenger counts and car stop counts. The expected boarding rates are then calculated. This boarding rate is then used as the expected queue behind the hall call. Thus, when a car is selected for assignment to the hall call, if the car does not have enough spare capacity, an additional car is sent to the same hall call floor. However, this estimated queue size does not take into account the queue build up in the future and does not send a car based on any expected increase in queue size. The enhanced RSR may send one car to a floor, because it calculates the boarding rate to be low. But the actual queue may be large, because no car answered the hall call for a long time.

Similarly, even if two cars are sent to a floor, that may not be adequate if the crowd is building at a fast rate. When a crowd is present, if a car stops for hall call in that direction, the car will become full. So a car which is going to stop at a crowded floor should not be assigned for additional hall calls, until it makes a car call stop after the crowded floor. Otherwise, other hall calls assigned after the crowded floor will have to be later reassigned.

The varying RSR algorithm of the co-pending application Ser. No. 07/192,436 and the enhanced RSR algorithm of the concurrently filed application Ser. No. 318,307 park the empty cars at the first floor of the parking zones. Though a crowd is expected at some floors, cars are not parked at those floors due to the lack of any crowd prediction.

For further general background information on RSR elevator car assignment systems, either with set or variable bonuses and penalties, reference is had to assignee's U.S. Pat. No. 4,363,381 issued to Joseph Bittar on Dec. 14, 1982, and the above-referenced Ser. No. 07/192,436, respectively. These approaches are further discussed in the sub-section entitled "RSR Assignments of Prior Approaches" below.

General Approach of Invention

The current invention originated from a desire to improve service to crowded floors, using "artificial intelligence" techniques to predict traffic levels and crowd build up at various floors.

Part of the strategy of the present invention is accurate prediction or forecasting of traffic demands in the form of boarding counts and de-boarding counts and car stop counts using single exponential smoothing and/or linear exponential smoothing. It is noted that some of the general prediction or forecasting techniques of the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

DISCLOSURE OF INVENTION

Thus, the present invention and its preferred algorithms originated from the desire to improve service to crowded floors, using "artificial intelligence" techniques to predict the traffic levels and any crowd build up at various floors, and use these predictions to better assign one, two or more cars to the "crowd" predicted floors, either parking them there, if they were empty, or, if in active service, more appropriately assigning the car(s) to the hall calls.

Part of the strategy of the present invention is the accurate prediction or forecasting of traffic dynamics in the form of "crowds" using preferably single exponential smoothing and/or linear exponential smoothing and numerical integration techniques. In the invention the traffic levels at various floors are predicted by collecting the passengers and car stop counts in real time and using real time, as well as historic prediction if available, for the traffic levels.

A "crowd" within the context of the present invention represents a relatively large number of passengers, for example, of the order of about twelve (12) or more awaiting passengers going in a particular direction. Of course a number less than twelve could be used, depending on a number of factors, including the number of cars, number of floors, etc. As a practical matter, a "crowd" should be considered to be no less than at least three (3) passengers and more typically eight (8), ten (10) or twelve (12) or more passengers.

The predicted passenger arrival counts are used to predict the crowd at relatively short intervals, for example, every fifteen (15) seconds, at the floors where significant traffic is predicted. The crowd prediction is then adjusted for the hall call stops made and the numbers of passengers picked up by the cars.

The crowd direction is derived from the traffic direction. The crowd dynamics are matched to car assignment so that one, two, or more than two cars can be sent to the crowded floor. Any empty cars preferably are parked at the floors where a crowd is expected later.

By these techniques, more efficient service is provided by the RSR algorithm used in the preferred exemplary embodiment of the present invention, when crowds are present at one or more floors.

The present invention thus controls the elevator cars to be dispatched based on dispatcher algorithms preferably with variable bonuses and penalties using "artificial intelligence" ("AI") techniques based on historic and real time traffic predictions to predict the presence of "crowd(s)" at various floors, and using this information to better service the crowded floor(s) and park empty or currently inactive car(s) at the "crowded" floor(s).

For example, when significant passenger boarding rates are observed at any floor in any direction, the crowd size is computed at that floor in that direction. The crowd size is computed by summing up the average passenger arrival rate for, for example, each fifteen (15) seconds. So for all such floors and direction the crowd count will be predicted and stored at fifteen (15) seconds intervals.

If the computed crowd size exceeds a pre-set "crowd limit," for example, twelve (12) passengers, a crowd signal is generated. When a crowd signal is present, if a hall call also has been registered, both the car with the lowest RSR value and the one with the next lowest RSR value will be assigned to answer the hall call.

These and other related RSR techniques will be described in greater detail below.

As will be understood more fully from the below detailed description, the crowd sensing features of the present invention use "artificial intelligence" based traffic predictions and real time crowd dynamics monitoring using numerical integration techniques and do not require separate sensors to monitor the crowds.

The invention may be practiced in a wide variety of elevator systems, utilizing known technology, in the light of the teachings of the invention, which are discussed in detail hereafter.

Other features and advantages will be apparent from the specification and claims and from the accompanying drawings, which illustrate an exemplary embodiment of the invention.

BRIEF DESCRIPTION OF DRAWINGS

FIG. 1 is a simplified, schematic block diagram, partially broken away, of an exemplary elevator system in which the present invention may be incorporated; while

BEST MODE FOR CARRYING OUT THE INVENTION

Exemplary Elevator Application

For the purposes of detailing an exemplary application of the present invention, the disclosures particularly of the prior Bittar U.S. Pat. No. 4,363,381 , as well as of a commonly owned U.S. Pat. No. 4,330,836 entitled "Elevator Cab Load Measuring System" of Donofio & Games issued May 18, 1982, are incorporated herein by reference.

The preferred application for the present invention is in an elevator control system employing a microprocessor-based group controller dispatcher using signal processing means, which communicates with the cars of the elevator system to determine the conditions of the cars and responds to hall calls registered at a plurality of landings in the building serviced by the cars under the control of the group controller, to provide assignments of the hall calls to the cars based on the weighted summation for each car, with respect to each call, of a plurality of system response factors indicative of various conditions of the car irrespective of the call to be assigned, as well as indicative of other conditions of the car relative to the call to be assigned, assigning "bonuses" and "penalties" to them in the weighted summation. A exemplary elevator system and an exemplary car controller (in block diagram form) are illustrated in FIGS. 1 and 2, respectively, of the '381 patent and described in detail therein.

Figure 1:
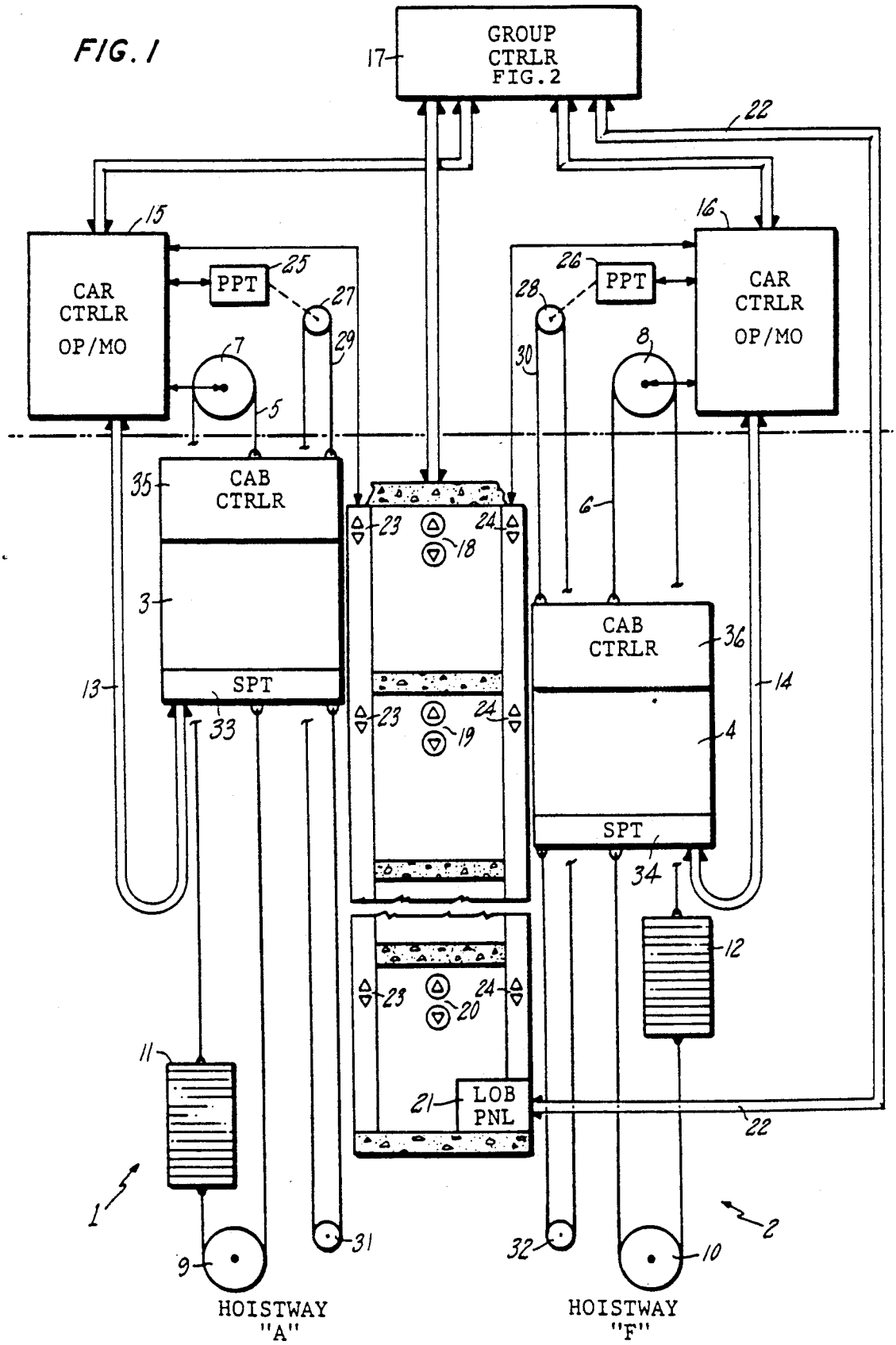
Figure 2:
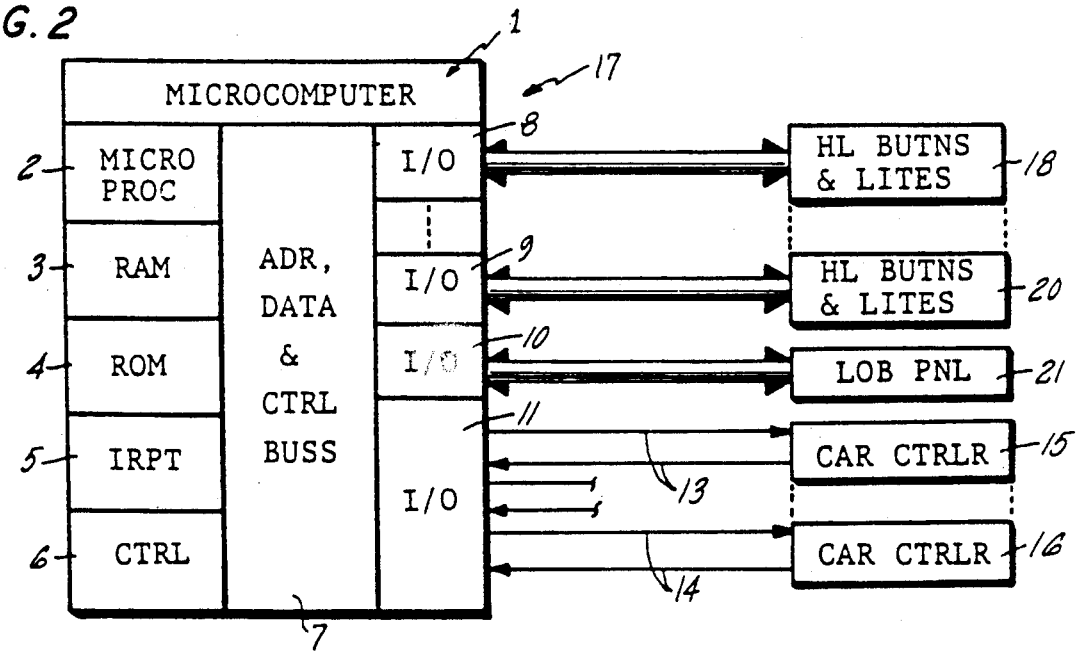
FIG. 2 is a simplified, schematic block diagram of an exemplary car controller, which may be employed in the system of FIG. 1, and in which the invention may be implemented.

It is noted that FIGS. 1 and 2 hereof are substantively identical to the same figures of the '381 patent and the above-referenced, co-pending application Ser. No. 07/192,436. For the sake of brevity the elements of FIGS. 1 and 2 are merely outlined or generally described below, as was done in the co-pending application, while any further, desired operational detail can be obtained from the '381 patent, as well as other of assignee's prior patents.

In FIG. 1, a plurality of exemplary hoistways, HOISTWAY "A" 1 and HOISTWAY "F" 2 are illustrated, the remainder not being shown for simplicity purposes. In each hoistway, an elevator car or cab 3, 4 is guided for vertical movement on rails (not shown).

Each car is suspended on a steel cable 5, 6, that is driven in either direction or held in a fixed position by a drive sheave/motor/brake assembly 7, 8, and guided by an idler or return sheave 9, 10 in the well of the hoistway. The cable 5, 6 normally also carries a counterweight 11, 12, which is typically equal to approximately the weight of the cab when it is carrying half of its permissible load.

Each cab 3, 4 is connected by a traveling cable 13, 14 to a corresponding car controller 15, 1 6, which is typically located in a machine room at the head of the hoistways. The car controllers 15, 16 provide operation and motion control to the cabs, as is known in the art.

In the case of multi-car elevator systems, it has long been common to provide a group controller 17, which receives up and down hall calls registered on hall call buttons 18-20 on the floors of the buildings and allocates those calls to the various cars for response, and distributes cars among the floors of the building, in accordance with any one of several various modes of group operation. Modes of group operation may be controlled in part, for example, by a lobby panel ("LOB PNL") 21, which is normally connected by suitable building wiring 22 to the group controller in multi-car elevator systems.

The car controllers 15, 16 also control certain hoistway functions, which relate to the corresponding car, such as the lighting of "up" and "down" response lanterns 23, 24, there being one such set of lanterns 23 assigned to each car 3, and similar sets of lanterns 24 for each other car 4, designating the hoistway door where service in response to a hall call will be provided for the respective up and down directions.

The position of the car within the hoistway may be derived from a primary position transducer ("PPT") 25, 26. Such a transducer is driven by a suitable sprocket 27, 28 in response to a steel tape 29, 30, which is connected at both of its ends to the cab and passes over an idler sprocket 31, 32 in the hoistway well.

Similarly, although not required in an elevator system to practice the present invention, detailed positional information at each floor, for more door control and for verification of floor position information derived by the "PPT" 25, 26, may employ a secondary position transducer ("SPT") 33, 34. Or, if desired, the elevator system in which the present invention is practiced may employ inner door zone and outer door zone hoistway switches of the type known in the art.

The foregoing is a description of an elevator system in general, and, as far as the description goes thus far, is equally descriptive of elevator systems known to the prior art, as well as an exemplary elevator system which could incorporate the teachings of the present invention.

All of the functions of the cab itself may be directed, or communicated with, by means of a cab controller 35, 36 in accordance with the present invention, and may provide serial, time-multiplexed communications with the car controller, as well as direct, hard-wired communications with the car controller by means of the traveling cables 13 and 14. The cab controller, for instance, can monitor the car call buttons, door open and door close buttons, and other buttons and switches within the car. It can also control the lighting of buttons to indicate car calls and provide control over the floor indicator inside the car, which designates the approaching floor.

The cab controller 35, 36 interfaces with load weighing transducers to provide weight information used in controlling the motion, operation, and door functions of the car. The load weighing data used in the invention may use the system disclosed in the above cited '836 patent.

An additional function of the cab controller 35, 36 is to control the opening and closing of the door, in accordance with demands therefore, under conditions which are determined to be safe.

The makeup of microcomputer systems, such as may be used in the implementation of the car controllers 15, 16, a group controller 17, and the cab controllers 35, 36, can be selected from readily available components or families thereof, in accordance with known technology as described in various commercial and technical publications. The software structures for implementing the present invention, and peripheral features which may be disclosed herein, may be organized in a wide variety of fashions.

RSR Assignments of Prior Approaches

As noted above, an earlier car assignment system, which established the RSR approach and was described in the commonly owned '381 patent, included the provision of an elevator control system in which hall calls were assigned to cars based upon Relative System Response (RSR) factors and provided the capability of assigning calls on a relative basis, rather than on an absolute basis, and, in doing so, used specific, pre-set values for assigning the RSR "bonuses" and "penalties".

However, because the bonuses and penalties were fixed and preselected, waiting times sometimes became large, depending on the circumstances of the system. Thus, although the '381 invention was a substantial advance in the art, further substantial improvement was possible and was achieved in the invention of the above-referenced, copending application Ser. No. 07/192,436.

In that invention the bonuses and penalties were varied, rather than preselected and fixed as in the '381 invention, as functions, for example, of recently past average hall call waiting time and current hall call registration time, which could be used to measure the relatively current intensity of the traffic in the building. An exemplary average time period which could be used was five (5) minutes, and a time period of that order was preferred.

During system operation, the average hall call waiting time for the selected past time period was estimated using, for example, the clock time at hall call registration and the hall call answering time for each hall call and the total number of hall calls answered during the selected time period. The hall call registration time was computed, from the time when the hall call was registered until the time when the hall call was to be assigned. According to that invention, the penalties and bonuses were selected, so as to give preference to the hall calls that remain registered for a long time, relative to the past selected period's average waiting time of the hall calls.

When the hall call registration time was large compared to the past selected time period's average wait time, then the call would have high priority and thus should not wait for, for example, cars having a coincident car call stop or a contiguous stop and should not wait for cars having less than the allowable number of calls assigned, MG set on and not parked. Thus, for these situations, the bonuses and penalties would be varied by decreasing them.

When the hall call registration time was small compared to the selected time period's average waiting time, the reverse situation would be true, and the bonuses and penalties would be varied for them by increasing them.

The functional relationship used to select the bonuses and penalties related, for example, the ratio of hall call registration time to the average past selected time period's hall call waiting time to the increases and decreases in the values of the bonuses and penalties.

As a variant to the foregoing, the bonuses and penalties could be decreased or increased based on the difference between the current hall call registration time and the past selected time period's average hall call waiting time as a measure of current traffic intensity.

In the enhanced RSR approach of the concurrently filed application, a need to distribute the car load and car stops more equitably was recognized, so as to minimize the service time and the waiting time of passengers and improve handling capacity. This distribution is achieved by, for example, "knowing" through prediction the number of people waiting behind the hall call, the number of people expected to be boarding and de-boarding at various car stops, and the currently measured car load.

Using this information, the car's load at the hall call floor is calculated, and the resulting spare capacity matched with the predicted number of people waiting at the hall call floor. The car stops for hall call and car call are penalized based on the expected passenger transfer time and the expected number of people waiting behind the hall call, so that, when a large number of people are waiting, a car with fewer "en route" stops is selected.

If a car does not have a coincident car call stop at the hall call floor and the car is a heavily loaded car, stopping that car to pick up a few people is undesirable. This is penalized by using a car load penalty which varies proportional to the number of people in the car, but at a lower rate as a function of the number of people waiting at the hall call floor.

Past system information is also recorded in "historic" and "real time" data bases, and the stored information used for further prediction.

This enhanced RSR approach thus dispatches cars based on a dispatcher algorithm with variable bonuses and penalties using "artificial intelligence" ("AI") techniques based on historic and real time traffic predictions to predict the number of people behind a hall call, the expected car load at the hall call floor, and the expected boarding rate and the de-boarding rate at "en route" stops, and varying the RSR bonuses and penalties based on this information. The resulting car assignment, in distributing car stops and loads more equitably, thus improves service quality and handling capacity.

As explained more fully below, the enhanced RSR approach of the concurrently filed application can be and preferably is used in conjunction with the present invention.

Exemplary "AI" Based Crowd Sensing System

The "AI" principles used in the invention and the application of the invention in a detailed exemplary embodiment will be discussed first, and then the exemplary embodiment will be further discussed in association with the drawings.

Between, for example, 6:00 AM and midnight, that is for the whole active work day, at each floor in the building in each direction, the following traffic data is collected for short periods of time, for example, each one (1) minute interval, in terms of the:

- number of hall call stops made,
- number of passengers boarding the cars using car load measurements at the floors,
- number of car call stops made, and
- number of passengers de-boarding the cars, again using car load measurements at the floors.

At the end of each interval, the data collected during, for example, the past three intervals at various floors in terms of passenger counts and car stop counts are analyzed. If the data shows that car stops were made at any floor in any direction in, for example, two (2) out of the three (3) past minutes and on the average more than, for example, two (2) passengers boarded or two (2) passengers de-boarded each car at that floor and direction, during at least two (2) intervals, the real time prediction for that floor and direction is initiated.

The traffic for the next few two (2) or three (3) minute intervals for that floor, direction and traffic type (boarding or de-boarding) is then predicted, using preferably a linear exponential smoothing model. Both passenger counts and car stop counts (hall call stops or car call stops) are thus predicted.

Large traffic volume may be caused by normal traffic patterns occurring on each working day of the week or due to special events occurring on the specific day.

The real time prediction is terminated, when the total number of cars stopping at the floor in that direction and for that traffic type is less than, for example, two (2) for four (4) consecutive intervals and the average number of passengers boarding the cars or de-boarding the cars during each of those intervals is less than, for example, two (2.0).

Whenever significant traffic levels have been observed at a floor in a direction and real time traffic predictions made, the real time collected data for various intervals is saved in the historic data base, when the real time prediction is terminated. The floor where the traffic was observed, the traffic direction and type of traffic in terms of boarding or de-boarding counts and hall call stops or car call stops are recorded in the historic data base. The starting and ending times of the traffic and the day of the week are also recorded in the historic data base.

Once a day, at midnight, the data saved during the day in the historic data base is compared against the data from the previous days. If the same traffic cycle repeats each working day within, for example, a three (3) minute tolerance of starting and ending times and, for example, a fifteen (15%) percent tolerance in traffic volume variation during the first four and last four short intervals, the current day's data is saved in the normal traffic patterns file.

If the data does not repeat on each working day, but if the pattern repeats on each same day of the week within, for example, a three (3) minute tolerance of starting and ending times and, for example, a fifteen (15%) percent tolerance in traffic volume variation during the first four and last four intervals, the current day's data is saved in the normal weekly patterns file.

After the data collected during the day are thus analyzed and saved in the normal patterns file and normal weekly patterns file, all the data in those files for various floors, directions, traffic types are used to predict traffic for the next day. For each floor, direction and traffic type, the various occurrences of historic patterns are identified one by one. For each such occurrence, the traffic for the next day is predicted using the data at the previous occurrence and the predicted data at the last occurrence and using the exponential smoothing model. All normal traffic patterns and normal weekly traffic patterns expected to be occurring on the next day are thus predicted and saved in the current days historic prediction data base.

At the end of each data collection interval, the floors and directions where significant traffic has been observed, are identified. After the real time traffic for the significant traffic type has been predicted, the current day's historic prediction data base is checked to identify if historic traffic prediction has been made at this floor and direction for the same traffic type for the next interval.

If so, then the two predicted values are combined to obtain optimal predictions. These predictions will give equal weight to historic and real time predictions and hence will use a weighing factor of one-half (0.5) for both. If however, once the traffic cycle has started, the real time predictions differ from the historic prediction by more than, for example, twenty (20%) percent in, for example, four (4) out of six (6) one minute intervals, the real time prediction will be given a weight of, for example, three-quarters (0.75) and the historic prediction a weight of one-quarter (0.25), to arrive at a combined optimal prediction.

The real time predictions shall be made for passenger boarding or de-boarding counts and car hall call or car call stop counts for up to three (3) or four (4) minutes from the end of the current interval. The historic prediction data for up to three or four minutes will be obtained from the previously generated data base. So the combined predictions for passenger counts and car counts can also be made for up to three to four minutes from the end of the current interval.

If no historic predictions have been made at that floor for the same direction and traffic type for the next few intervals, the real time predicted passenger counts and car counts for the next three (3) or four (4) minutes are used as the optimal predictions.

Using this predicted data, the passenger boarding rate and de-boarding rate at the floor where significant traffic occurs are then calculated. The boarding rate is calculated as the ratio of total of passengers boarding the cars at that floor in that direction during that interval to the number of hall call stops made at that floor in that direction during the same interval. The deboarding rate is calculated as the ratio of number of passengers de-boarding the cars at that floor, in that direction in that interval to the number of car call stops made at that floor in that direction in the same interval.

The boarding rate and de-boarding rate for the next three (3) to four (4) minutes for the floors and directions where significant traffic is observed are thus calculated once a minute. If the traffic at a floor and a direction is not significant, i.e. less than, for example, two (2) persons board the car or de-board the car on the average, the boarding or de-boarding rates are not calculated.

Figure 3A:
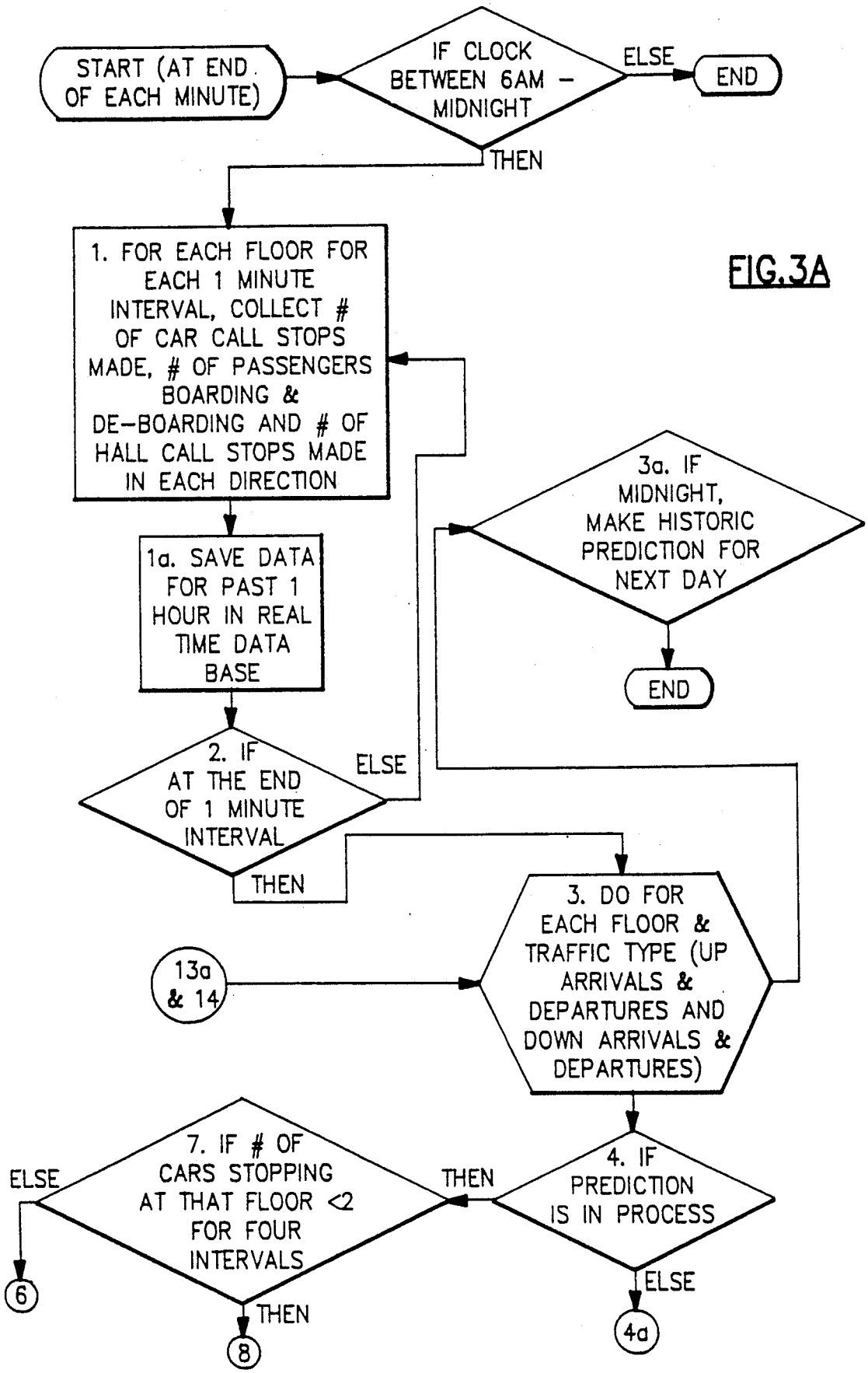
FIGS. 3A and 3B, in combination, provide a simplified, logic flow diagram for the exemplary algorithm for the methodology used to collect and predict traffic and passenger boarding and de-boarding rates at various floors in the preferred embodiment of the present invention.
Figure 3B:
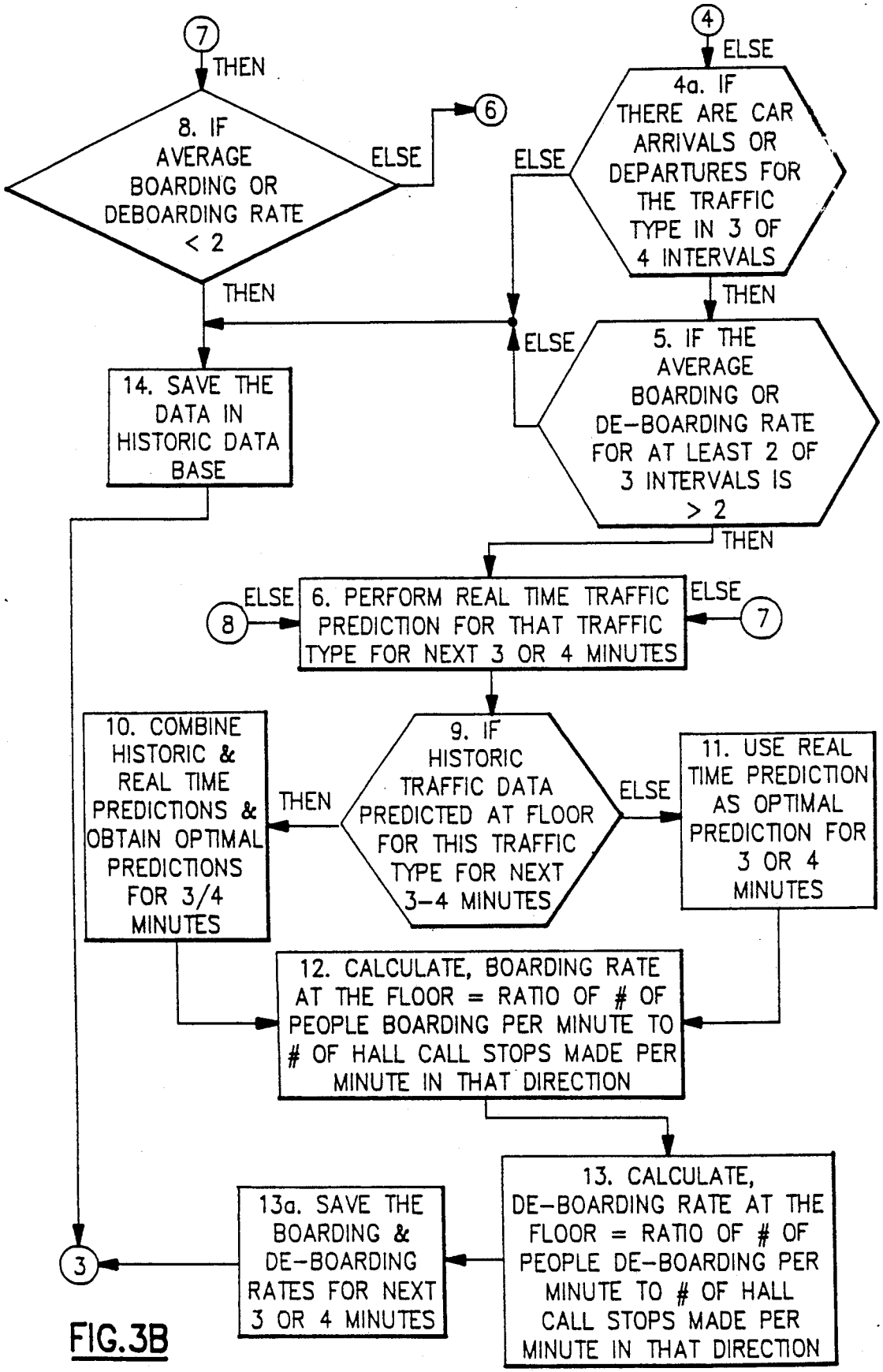
Figure 4A:
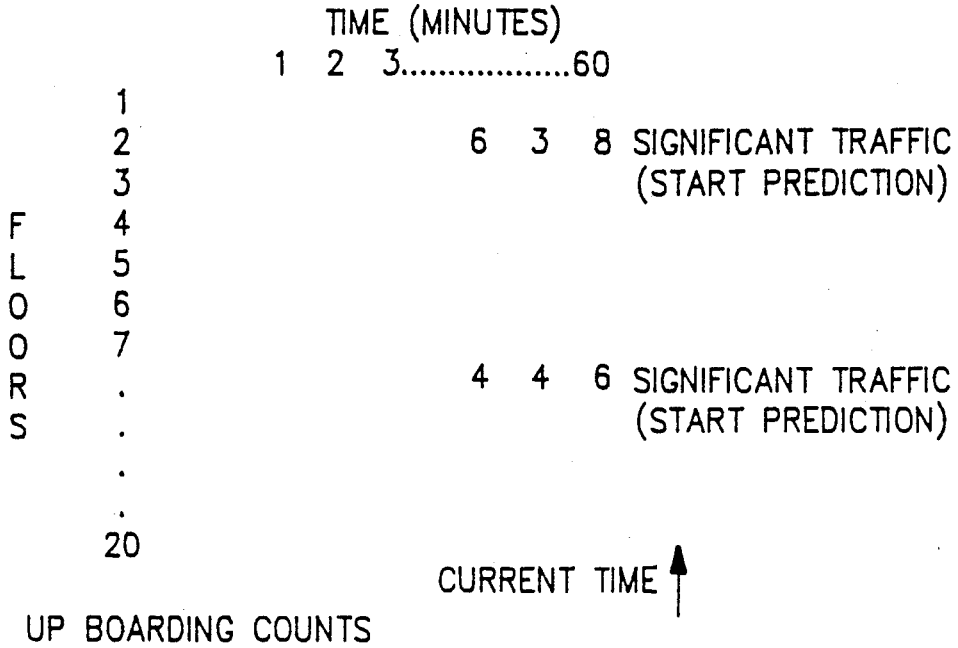
FIGS. 4A and 4B are general illustrations of matrix diagrams illustrating the collection of the real time data in arrays used in the exemplary embodiment of the present invention, showing the collection of "up" boarding counts and "up" hall stop counts at various floors.
Figure 4B:
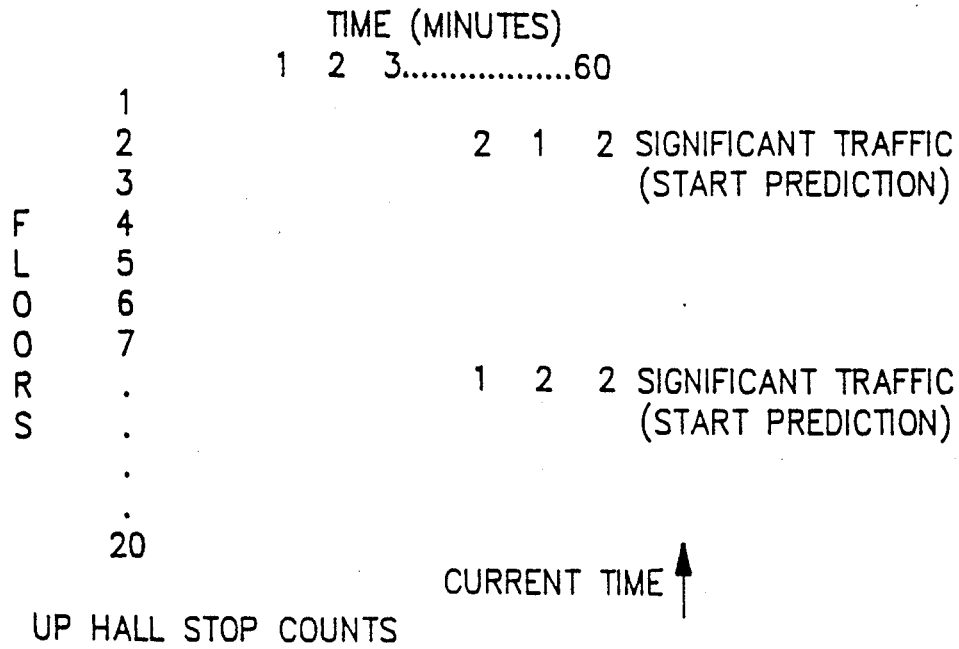

As a particular example of the foregoing, used as the exemplary embodiment of the present invention, the logic block diagram of FIGS. 3A and 3B illustrates the exemplary methodology to collect and predict traffic and compute boarding and de-boarding rates. In steps 3-1 and 3-2 the traffic data is collected for, for example, each one (1) minute interval during an appropriate time frame covering at least all of the active work day, for example, from 6:00 AM until midnight, in terms of the number of passengers boarding the car, the number of hall call stops made, the number of passengers de-boarding the car, and the number of car call stops made at each floor in the "up" and "down" directions. The data collected for, for example, the latest one (1) hour is saved in the data base, as generally shown in FIGS. 4A and 4B and step 3-1.

In steps 3-3 to 3-4*a* at the end of each minute the data is analyzed to identify if car stops were made at any floor in the "up" and "down" direction in, for example, two (2) out of three (3) one minute intervals and, if on the average more than, for example, two (2) passengers de-boarded or boarded each car during those intervals. If so, significant traffic is considered to be indicated. The traffic for, for example, the next three (3) to four (4) minutes is then predicted in step 3-6 at that floor for that direction using real time data and a linear exponential smoothing model, as generally described in the *Makridakis & Wheelwright* text cited above, particular Section 3.6, and, as applied to elevator dispatching, in the specification of the parent application cited above. Thus, if the traffic "today" varies significantly from the previous days, traffic, this variation is immediately used in the predictions.

If this traffic pattern repeats each day or each same day of the week at this floor, the data would have been stored in the historic data base and the data for each two (2) or three (3) minute intervals predicted the previous night for this day, using, for example, the method of moving averages or, more preferably, a single exponential smoothing model, which model is likewise generally described in the text of *Makridakis & Wheelwright* cited above, particularly Section 3.3, and, as applied to elevator dispatching, in the specification of the parent application cited above.

If such prediction is available, the historic and real time predictions are combined to obtain optimal predictions in step 3-10. The predictions can combine both real the time predictions and the historic predictions in accordance with the following relationship:

$$X = ax_h + bx_r$$

where "X" is the combined prediction, "$x_h$" is the historic prediction and "$x_r$" is the real time prediction for the short time period for the floor, and "a" and "b" are multiplying factors.

Initially, "a" and "b" values of one-half (0.5) are used. If real time predictions differ from historic predictions by more than, for example, twenty (20%) percent for several intervals, the "a" value is reduced and the "b" value is increased, as previously mentioned.

If historic predictions are not available, real time prediction is used for the optimal predictions, as shown in step 3-11.

As can be seen in the figures, other detailed steps or features are included in the algorithm of FIGS. 3A and 3B, but are considered to be self-explanatory in view of the foregoing.

Then, for each floor and direction where significant traffic has been predicted in step 3-12, the average boarding rate is calculated as, for example, the ratio of the predicted number of people boarding the car during the interval to the number of hall call stops made in that interval. The average de-boarding rate is computed in step 3-13 as the ratio of the predicted number of people de-boarding the car during an interval to the number of car call stops made in that interval. These rates are calculated for the next three to four minutes and saved in the data base.

Then, when a hall call is received from a floor, the RSR value for each car is calculated, taking into account the hall call mismatch penalty, the car stop and hall stop penalty and the car load penalty, which are all varied based on the predicted number of people behind the hall call, the predicted car load at the hall call floor and the predicted boarding and de-boarding rate at "en route" stops.

The foregoing is substantively identical to the initial methodology of the concurrently filed application.

Figure 5:
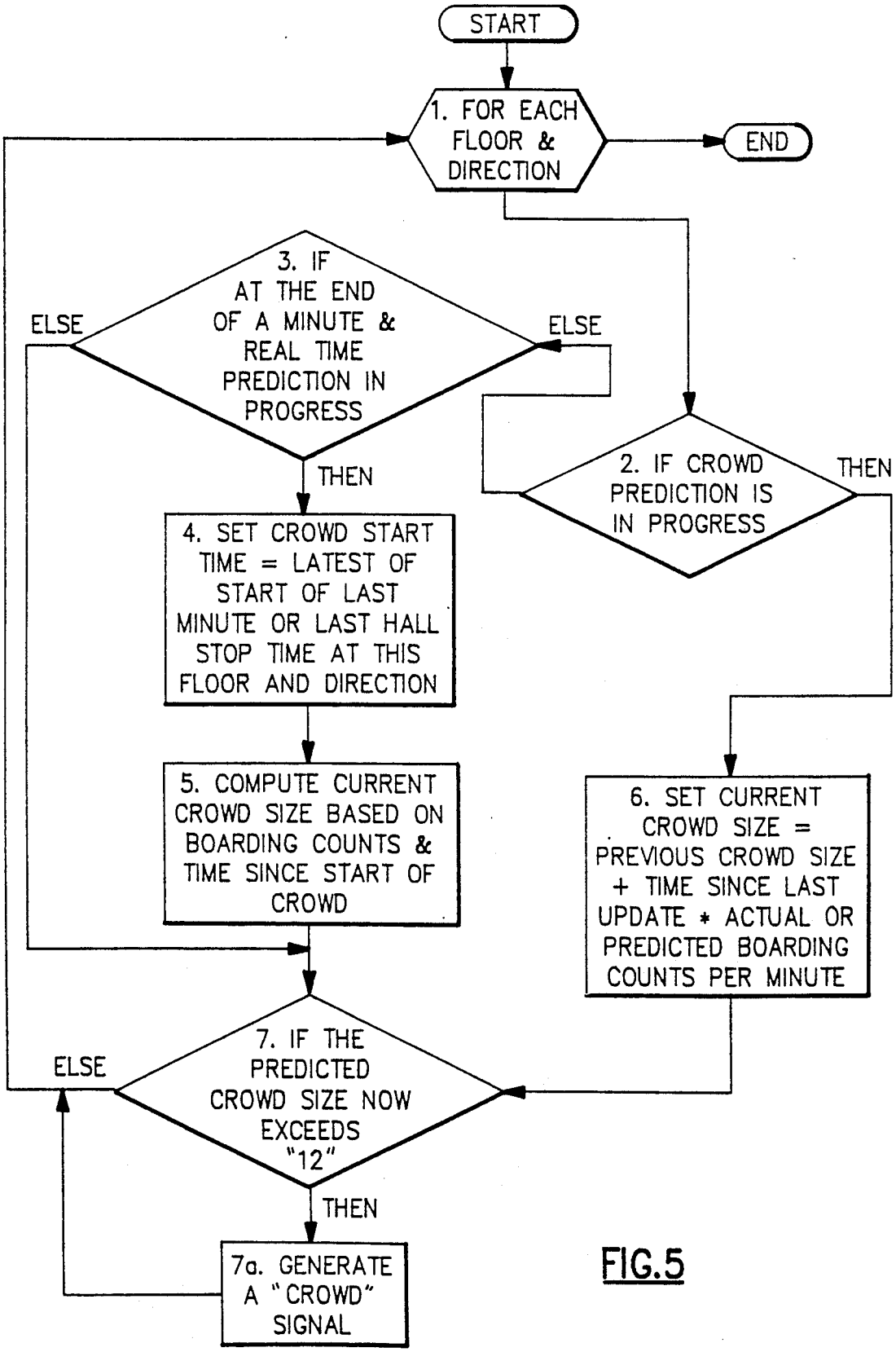
FIG. 5 is a simplified, logic flow diagram for the exemplary algorithm for the methodology used to compute crowd size at the floors at the end of fifteen (15) second intervals.

Reference is now had to the logic block diagram of FIG. 5, which illustrates the exemplary methodology to predict any crowd at the end of, for example, each fifteen (15) second interval, used in the exemplary embodiment of the present invention.

The crowd prediction algorithm of FIG. 5 is executed periodically once every fifteen (15) seconds. This algorithm checks each floor and direction and determines if crowd prediction is in progress for that traffic (steps 5-1 and 5-2). If not, in step 5-3, if at the end of a minute and real time traffic prediction has been made for that traffic (so significant traffic has been observed during the past several minutes), then in step 5-4 the crowd start time is set at the latest of the start of the last minute or the last time a car stopped for a hall call at this floor and direction. Then, in step 5-5, using the past minutes' predicted boarding counts, the predicted "crowd" (until the current time) is computed as the product of crowd accumulation time and passenger boarding count per minute.

If in step 5-2 the crowd prediction is in progress, then the last time when a "crowd" was predicted may be fifteen (15.0) seconds before or may be the last time a car stopped for a hall call at this floor and picked up some people. So in step 5-6 the current crowd size can be computed using the time since the last crowd update and the actual or predicted boarding counts per minute.

In step 5-7, if the predicted crowd size now exceeds, for example, twelve (12) people, a "crowd signal" is generated in step 5-7*a*.

The cars may be assigned to hall calls in assignment cycles at regular intervals of, for example, two hundred and fifty milliseconds (250 msec). If so, during these assignment cycles, the "up" hall calls are first assigned starting from the one at the lobby and proceeding upwards until the floor below the top most floor. The "down" hall calls are then assigned starting from the top most floor and then proceeding downward, until the floor just above the lobby.

Figure 6:
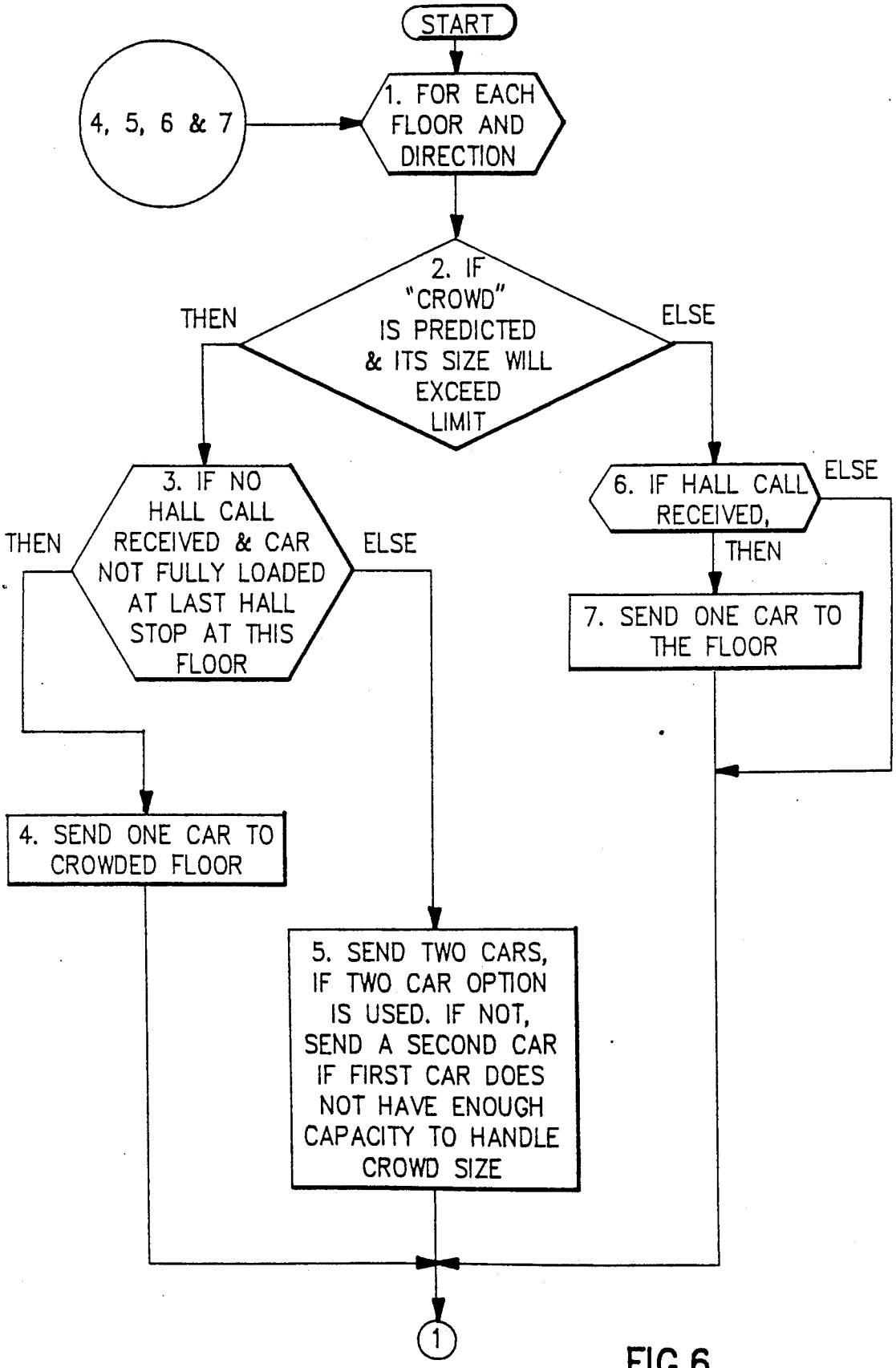
FIG. 6 is a simplified, logic flow diagram for the exemplary algorithm for the methodology used for car assignment to serve crowded floor(s) in which one or more cars are assigned for each of the crowded floor(s).

With reference to FIG. 6, which illustrates the methodology for selecting one or more cars for the crowded floor(s), for each floor and direction (step 6-1), a check is made in step 6-2 to identify if a crowd was predicted and if its size will exceed a "crowd limit," for example twelve (12) persons. If a crowd was predicted at a floor for a direction, then in step 6-3, if no hall call has been received from that floor in that direction, a decision is made in step 6-4 to assign one car to that floor and direction, if no car stopped for hall call at that floor and direction during the past, for example, three (3) minutes or the car which stopped for hall call at that floor and direction was partially loaded when it closed its doors. On the other hand, if a car stopped at that floor and direction within the past three minutes and left the floor fully loaded, in step 6-5 a decision is made to assign two cars for that floor and direction, if "two car options" is used; if not, one car will be sent if it has enough spare capacity to handle the currently predicted crowd; if the car does not have enough capacity, two cars will be sent to that floor and direction.

If a hall call is received from the floor for the direction for which a crowd is predicted, two cars are sent if the "two car option" is used. If not, the decision to send only one car or two cars will depend on if the first car has enough spare capacity to handle the currently predicted crowd.

If in step 6-6 a hall call is received from a floor, but no crowd has been predicted in step 6-2, one (note step 6-7) or two cars will be assigned to the hall call as proposed in the concurrently filed application. The actual car(s) selected for assignment will then be based on the minimizing of the enhanced RSR measure as discussed in that application.

If the cyclical car assignment to hall calls are executed at intervals greater than one (1.0) second, then whenever the crowd prediction algorithm predicts a "crowd" at any floor, it will be followed by the algorithm to select one or more cars for the crowded floors. Then the RSR algorithm will be executed and the cars assigned to crowded floors and hall calls.

When a car assigned to a crowded floor reaches the floor's commitment point, the car will decelerate to the floor if a hall call is pending at that floor or if the car is empty, allowing it to be parked at that floor, or if the last car that stopped for a hall call in that direction left the floor fully loaded. When the car reaches the crowded floor and opens the doors, if there were no passengers boarding the car, and if the car was empty, the car will park at that floor and thus wait for the arrival of the predicted crowd. It may then keep its doors open.

If, when the car reaches the crowded floor, the car is not empty and does not become empty, then when it closes the door, it sends its passenger boarding counts to the group controller. If the car was partially loaded, the crowd size is reset to zero ("0"), assuming all passengers waiting for the car have boarded the car then. So the crowd prediction algorithm will update the crowd size from this zero condition. If, on the other hand, the car was fully loaded when it closed its doors, the crowd size is updated by adding the estimated arrivals since the last crowd update and then subtracting the boarding counts for this car.

If the crowd size was set ,to zero, then if another car has also been assigned to this floor for crowd service, its assignment is cancelled. If the crowd size is not zero, but does not exceed the crowd limit, the car currently on its way to this floor, keeps its assignment.

Then the crowd size will be predicted again after fifteen (15) seconds. If the crowd size exceeds the "crowd limit", then if the previous car was fully loaded, then a decision is made to send two cars to this floor if the "two car option" is used or the spare capacity in the first car cannot handle the crowd predicted. If the car that left the floor previously was only partially loaded, only one car will be sent to this floor, if crowd is predicted, and none if no crowd is predicted.

If a crowd is predicted, the cycle of car assignment to hall calls will be executed immediately if the cycle interval is more than one (1.0) second; otherwise, the cycle will be executed at the next scheduled time.

The algorithms of the present invention thus dynamically keeps track of queue build up and dissipation. It sends cars to crowded floors before a hall call is registered, if a crowd is predicted. It sends multiple cars to the crowded floor, if a hall call is received from the floor, or if the car that stopped previously at this hall call floor left fully loaded.

This is similar to automatic hall call registration. The algorithms provide for assigning two cars automatically or sending the second car only if the first car does not have enough capacity to handle the predicted crowd.

A variation of this algorithm can select more than two cars, if the predicted crowd is such that, the two successive cars selected by the enhanced RSR algorithm will not have the capacity to handle the predicted traffic and the excess exceeds at least some minimum count, for example five (5) passengers.

The algorithm provides for selecting the crowded floor as a parking floor if the car is empty. The car park penalty described in the '381 patent for assigning this car to other hall calls will be increased by a certain fraction, for example, by half (½) of the difference between the lobby assigned penalty and the nominal car parked penalty, since this is a desirable floor for parking. This fraction will vary with the crowd size. Thus, when crowd prediction is used, the car parked penalty will be varied with the floor, based on the crowd size predicted.

When a car is assigned to a floor where a "crowd" is predicted, its car load computation after the passenger transfer at the crowded floor will use the predicted crowd size and the car's load when it reached the crowd floor. So, if the car is the first car, it may become full at the crowded floor and hence may not be eligible for car assignment to the hall call, until it makes its next car call stop. The hall call mismatch penalty for subsequent hall calls preferably should be based on the car load so computed. The second car may or may not be predicted to become fully loaded when it leaves the crowded floor.

Since the traffic data is predicted separately for the "up" and "down" directions, the crowd prediction is also done separately based on the predicted traffic levels for these directions. Thus, the algorithm is applicable, whether the crowd traffic goes up or down or in both directions.

This crowd sensing feature uses "artificial intelligence" based traffic prediction and real time crowd dynamics monitoring using numerical integration techniques and does not require separate sensors to monitor the crowds.

Although this invention has been shown and described with respect to at least one detailed, exemplary embodiment thereof, it should be understood that various changes in form, detail, methodology and/or approach may be made without departing from the spirit and scope of this invention.

Having thus described at least one exemplary embodiment of the invention, that which is new and desired to be secured by Letters Patent is claimed below:

1. In an elevator dispatching system, a method of controlling the number of elevator cars to be sent to a predetermined floor landing, said method comprising the steps of:

obtaining historical information of passenger arrival rates at a predetermined floor, said historical covering at least a predetermined time interval;

determining, based on said historical information, a passenger arrival rate at the predetermined floor for said predetermined time interval;

predicting, based on said determined passenger arrival rate, a crowd size at the predetermined floor for said predetermined time interval;

comparing said predicted crowd size with a predetermined crowd size threshold;

generating a crowd signal when said predicted crowd size exceeds said predetermined crowd size threshold; and controlling the number of elevator cars to be sent to the predetermined floor landing based on said generated crowd signal.

2. In an elevator dispatching system, the method of claim 1, said method further comprising the steps of:

assigning at least two elevator cars to the predetermined floor landing when a hall call is registered at the predetermined floor landing, if said crowd signal has been generated.

3. In an elevator dispatching system, the method of claim 1, said method further comprising the step of:

assigning one elevator car to the predetermined floor landing to wait for passengers, if said crowd signal has been generated, even through no hall call has been registered at the predetermined floor landing.

4. In an elevator dispatching system, the method of claim 1, said method further comprising the steps of:

assigning a first elevator car to the predetermined floor landing when a hall call is registered at the predetermined floor landing, if said crowd signal has been generated;

allowing at least a portion of awaiting passengers at the predetermined floor landing to board said first elevator;

determining whether said first elevator had enough capacity to handle all of the awaiting passengers at the predetermined floor landing; and assigning a second elevator to the predetermined floor landing if it is determined that said first elevator did not have enough capacity to handle all of the awaiting passengers at the predetermined floor landing.

5. In an elevator dispatching system, the method of claim 4 wherein it is determined that said first elevator did have enough capacity if said first elevator was not at its maximum capacity when it departed from the predetermined floor.

6. In an elevator dispatching system, the method of claim 1, said method further comprising the steps of:

if said crowd signal has been generated for the predetermined floor landing, then assigning at least two elevator cars to the predetermined floor landing when a hall call is registered at the predetermined floor landing;

otherwise, assigning one elevator car to the predetermined floor landing when a hall call is registered at the predetermined floor landing.

7. An elevator dispatching system to control the number of elevator cars to be sent to a predetermined floor landing, said system comprising:

means for measuring and storing information regarding passenger traffic at the predetermined floor during at least a predetermined time interval;

means for determining, based on said historical information, a passenger arrival rate at the predetermined floor for said predetermined time interval;

means for predicting, based on said determined passenger arrival rate, a crowd size at the predetermined floor for said predetermined time interval;

means for comparing said predicted crowd size with a predetermined crowd size threshold;

means for generating a crowd signal when said predicted crowd size exceeds said predetermined crowd size threshold; and means for assigning the number of elevator cars to be sent to the predetermined floor landing based on said generated crowd signal.

8. The elevator dispatching system of claim 7, said system further comprising:

means for assigning at least two elevator cars to the predetermined floor landing when a hall call is registered at the predetermined floor landing, if said crowd signal has been generated.

9. The elevator dispatching system of claim 7, said system further comprising:

means for assigning one elevator car to the predetermined floor landing to wait for passengers, if said crowd signal has been generated, even though no hall call has been registered at the predetermined floor landing.

10. The elevator dispatching system of claim 7, said system further comprising:

means for assigning a first elevator car to the predetermined floor landing when a hall call is registered at the predetermined floor landing, if said crowd signal has been generated;

means for determining whether said first elevator has enough capacity to handle all of the awaiting passengers at the predetermined floor landing; and means for assigning a second elevator to the predetermined floor landing if it is determined that said first elevator does not have enough capacity to handle all of the awaiting passengers at the predetermined floor landing.

11. The elevator dispatching system of claim 7, said system further comprising:

means for assigning at least two elevator cars to the predetermined floor landing when a hall call is registered at the predetermined floor landing, if said crowd signal has been generated for the predetermined floor landing; and means for assigning one elevator car to the predetermined floor landing when a hall call is registered at the predetermined floor landing, if said crowd signal has not been generated for the predetermined floor landing.

* * * * *

UNITED STATES PATENT AND TRADEMARK OFFICE

CERTIFICATE OF CORRECTION

PATENT NO. : 5,022,497

DATED : June 11, 1991

INVENTOR(S) : Kandasamy Thangavelu

It is certified that error appears in the above-identified patent and that said Letters Patent is hereby corrected as shown below:

On the Title page

In Item 75, please delete the inventor's incorrectly spelled name "Thanagavelu" and insert the correct spelling --Thangavelu-- in lieu thereof.

In Column 10, line 38, please delete the word "days," and insert --days'-- in lieu thereof.

In Column 14, line 13, after the word "historical", please insert the word --information--.

Signed and Sealed this

Twenty-third Day of February, 1993

*Attest:*

STEPHEN G. KUNIN

*Attesting Officer*

*Acting Commissioner of Patents and Trademarks*